114-253

2/4/86 XR 4,568,291 SR

United States Patent [19]

Nelson

[11] Patent Number: 4,568,291

[45] Date of Patent: Feb. 4, 1986

[54] STERN THRUSTOR FOR A TOW

[76] Inventor: Arthur J. Nelson, P.O. Box 3007, Daly City, Calif. 94015

[21] Appl. No.: 534,169

[22] Filed: Sep. 22, 1983

[51] Int. Cl.[4] ..... B63B 21/56

[52] U.S. Cl. ..... 114/246; 114/253; 440/53; 440/62; 440/67; 440/88

[58] Field of Search ..... 114/151, 246, 253; 440/53, 54, 58–60, 62, 67, 88

[56] References Cited

U.S. PATENT DOCUMENTS 394,174 12/1888 Grignon ..... 114/246
1,446,775 2/1923 Wahl ..... 440/88
2,265,485 12/1941 Johnson ..... 440/58
3,896,757 7/1975 Kucher ..... 440/88 X

FOREIGN PATENT DOCUMENTS 400491 7/1909 France ..... 440/59
2004253 11/1969 France ..... 440/53

*Primary Examiner*—Sherman D. Basinger

[57] ABSTRACT

A towline connected tug and LT at sea is rearranged as an articulatively integrated tow in sheltered waters to moor the LT or to make sternway in channels with a fair tide by a stern thrustor pivotally mounted to the transom of the LT or for a horizontal above water stowed position at sea.

2 Claims, 15 Drawing Figures

38
80
127
81
76m
77
76
39
128
126
43
128
130
137
140
44
44s
124
132
68c
68t
141
67t
131
129
42
43v
71t
43s
75
62
71b
40
142
72
41
73
141
123
61
29
79
41
62
59
63
34
68d
67
33
34
33
136
61
63
57
35s
68c
121
35p
68b
68p
65
53t
134t
50
46
55
51t
135t
62
29
56
45
48
135b
61
47
69c
134b
51b
53b
139
133
66
60
67
144
33
34
49
52
64
69
62
63
54

STERN THRUSTOR FOR A TOW

CROSS REFERENCES

Reference A—U.S. Pat. No. 4,275,677 issued June 30, 1981.

Reference B—application Ser. No. 06/441,751 filing date Nov. 15, 1982.

A summary of these references establishes a background of their form and practices as improved in the present application to distinguish from the prior art subsequently disclosed.

A carrier vessel with its burden lays-to a dock or another vessel to have cargo transferred therebetween during the time lapse between tug port calls to trade-off its tow for another as readied for sea. This lay-to and trade-off yields the coined expression lay-trader or more simply LT.

An LT is a hawser towed unmanned carrier vessel with a rudder; as required of all vessels at sea. With a rudder the hull then may be and is built with a ship-shaped forebody which barges without a rudder must forego. The afterbody of an LT is formed with a raked run (barge like), since there is no need for the fine ship form for water flow to a propeller. Unencumbered holds, a clear deck and free stern optimizes utility to multifarious cargo. Without propulsion machinery, steering gear, crew superstructure accommodations and stores those savings in weight together with increased displacement aft yields a cargo dead weight increase of about a third more than a dimensionally alike ship. Shipyard cost records reveal investment differences favoring the simpler structure.

LTs distinguish from the conventional barge which are "spoon bowed," stubby formed with skeg fitted sterns. The LT shipshaped formed hull may have both maximum beam/draft and length/beam factors to optimize sea performance, fuel economy and cargo input to shallow water ports. The full formed afterbody lessens pitching to lessen slamming damage of less susceptible forebodies. With a clear deck and free raked stern LTs optimize cargo discharge capabilities. As outfitted to suit Panama Canal (P.C.) code, an LT is applicable to coastwise, intercoastal and global offshore service. Proprietary gear aboard the LT for controlled tow is as follows:

A nylon towline from a tug is connected to a wire bridle extended from ends of a beam pivotally mounted to a forward structure of the LT. Lines from the pivotal beam are disposed aft as fixed to the rudder quadrant. The assembly provides for the rudder alignment with the LT's longitudinal centerline. The rigid fixture-like connection between the tensioned towline and pivotal beam remains normal (at right angles) one to the other throughout rudder angular changes.

With the slightest tendency for the LT to yaw off the tug heading, the towline and pivotal beam angularity with the LT changes. With that angular change an automatic corrective rudder angularity occurs at a factor of from 6 to 10 times that of the towline change. Instantaneous and adequate corrective rudder occurs to minimize yawing to turn the LT to track behind but not overshoot the tug heading.

LT rudders are not called on to produce turning circles as required of ships. LT rudders maintain directional stability against yaw to track with the tug heading. A buttress is part of the LT outfitting to suit P.C. code. In transit of "Canal" waters a stern member is required with "dead tows" (nonself-propelled vessels) to which a canal tug can nose in to control any sternwise waywardness of that vessel.

A fully automated tug is powered by a primary diesel engine for propulsion. A controllable pitch propeller (CPP) and its shrouding nozzle (Kort type) are preferably disposed forward for pull propulsion of the tug. Thus, with controlling members (propeller and rudder) disposed space apart fore and aft, forces acting to upset a tug's directional stability are contained by said members. This arrangement is exemplary of a simple beam with end reactions to support a load. A ship is exemplary of a cantilever beam. A directionally adjustable bow thruster is motor driven as powered by an auxiliary diesel engine. The latter serves all accessories not integrally attending the primary engine.

Variable pitch serves for ahead, reverse, and idle condition with angularity to feathered condition being meaningless. The need to maintain headway depends upon the number and size of LTs in tow and the sea state. The concept of free speed or maneuverability of harbor tugs is meaningless. Optimized thrust in pounds per horsepower with engines at maximum rated continuous power at constant speed to drive the CPP is a boon to the engine and tug performance.

Principal equipment on the tug after deck is comprised of dual traction winches for nylon towlines, a capstan, an aluminum truss formed "A" frame hinged to the tug after rail and an aluminum portable derrick likewise hinged at said rail but to a side of the "A" frame. While at sea the hinged members are disposed to support for a prone position.

The portable derrick is rigged erect to serve in the swing of the "A" frame from its position aboard the tug to an outboard approximately horizontal reach aft. The distal end of the "A" frame has an articulative clamping means remotely actuated by a cable connected lever aboard the tug. A heavy round bar fixed to the LT prow by suitably spaced apart ribs provides the means for said clamp to be universally fastened thereto. Thus, the "A" frame assumes its position relative to the existing draft of either LT in the trade-off.

The "A" frame is built with a catwalk as means to board the LT with the aid of a portable pole ladder. A springline cast from the moving LT to the watchman attending the lay-to LT is set to the dock. Peformance by the CPP and bowthrustor effects a series of jackknife forward, backing and swing maneuvers to position the LT as aided by the spring line. An anchor may be set to assist mooring with adverse currents.

The different displacement tug an LT respond individual to water swell behavior for relative motion between the clamp and bar to be engaged. Means to content with this behavior are developed in Reference B.

During a voyage various encounters are repeating occurrences. Simple and effective arrangements sustain the safe and expeditious transport and transfer of cargo between several ports along a trade route.

(1) At sea a single towline serves for automatic tracking of the LT with the tug heading.

(2) In a coastal inlet passage dual towlines are connected as extendable lengths of separated bridle legs to selectively divert the LT at will.

(3) At sea the dual towlines may be utilized to provide double tow of LTs, one trailing aft of the other as spaced apart to avoid towline chaffe. Accommodations between tugs and LTs provide for the transfer of LTs between tugs as performed to effect double or triple tow.

(4) So called turning circle of ships are not expected or required of a tow tracking behind a tug. But with an abrupt change in tug heading the towline angularity changes to align with one bridle leg with the pivotal beam at a stop for maximum rudder set. Then the towline augments the rudder to turn the LT.

(5) A docking procedure and means to trade off LTs is dependent on the articulative integration of tug and LT. A berthing procedure is timed to optimize the practiced method for an expeditious and seamanshiplike performance. Various supporting apparatus facilities the performance by reducing manual effort to monitoring with minor physical needs.

BACKGROUND OF THE INVENTION (1) Field of the Invention

This specification pertains to the control of vessels, more particularly when in sheltered waters and still more specifically to the stern end of vessels. Under certain circumstances all vessels lack controllability, but herein only non-self-propelled vessels which are hawser pull towed are included to distinguish from stern pushed barges. As disclosed above the preferred pulled towed vessel is more simply identified as an LT and arranged to be integrated with the tug.

(2) Description of the Prior Art

Control of the distinguished vessels relates to stern maneuverability to contend with a particular situation. Certain accessories and practices are adapted to contend with the vessels ineptness. Panama Canal code suggests 12×12 timbers be fixed as vessel stern fixtures to satisfy a requirement when in passage of the waters. Elsewhere, tugs lashed to the vessel side, are expected to maneuver a 'dead' barge; knowingly with questionable results. Shipbuilding has been involved with tunnel installed stern thrustors. Chain bridles and hawsers are let go to drag on the water bed to stop a 'dead' tow. (Dead tow meaning a non-self-propelled barge).

The required stern fixture and stern thrustor are adapted as modified and combined to serve the LT as a most reliable and expeditious means to serve the transient needs during a voyage.

PC. code reads—"Priority of arrival at a terminal does not give any vessel the right to pass through the Canal ahead of another that may arrive later." Discrimination against "dead tows" means hours more delay than experienced by "steamers". The present application serves to complete the LT tow arrangement to void this discrimination and facilitate maneuvers elsewhere for a safely and expeditiously conducted voyage.

SUMMARY

The raked aft end of conventional hawser towed vessels preclude the optimal use of a tunnel to house a stern thrustor as effected by ships. By Panama Canal code these barges, so called dead tows, are required to have stern members "secured vertically in such a position as to accept . . . and hold a (pusher) tug's stem to the centerline of the barge."

A pivotal buttress per Reference 'A' satisfies the above quoted requirement as arranged to be expeditiously erected in accommodation with the vessel's draft variance. The buttress optional utilization and rugged dual pipe construction lends ideally to the containment of a stern thrustor, itself an occasional accommodation during a voyage.

The thrustor is comprised of a nozzle shrouded propeller and its housed shaft assembly. The tear-drop shaped housing, fairing water flow to said propeller contains the spiral bevel gear mechanism for connection to its vertical driver column.

The driver column is disposed for lateral support between said dual pipes and extends with the buttress for an upper reach at deck level. A gear motor driving arrangement unirotationally turns the operating thrustor through 180° increments for a port or starboard directed compression force to the propeller shaft. An uppermost vertical motor is coupled to the driver column shaft extension of the bevel gear. A roller bearing arranged turntable transmits dead weight of the thrustor to the buttress.

The effectiveness of the thrustor to control the stern disposition of the towed vessel serves in two principal maneuvers. In the normal backing sequence to dock a vessel the thrustor definitely manages the required stern disposition while the tug with a controllable pitch propeller and bow thrustor provides propulsion and bow disposition of the vessel being docked.

In the transit of an inland passage having a strong following current the tow effects headway in an apparent backing arrangement. Then the forward end of tow is directionally assisted by the stern thrustor to negotiate bends in the passage. The passage is with the safer port side to the near shore.

DESCRIPTION OF THE PREFERRED EMBODIMENTS

Operating Conditions

The summary included above provides an outline of a preferred tow's equipment and practice to expeditiously transport cargo. Left for the present application to develop is that equipment made applicable for two specific situations. One situation relates to docking an LT (the preferred cargo conveying means according to Reference A). The other situation pertains to an independent controlled tow in a channel as subsequently disclosed. Said independence is established with the LT having a stern thrustor.

Both situations rely on an integrated arrangement of the tow as developed in Reference (A). The integrated tow is considered to be making headway with the tug's bow forwardly leading the directional travel. With the tug's bow most after located in the tow arrangement, the directional travel is an apparent backing procedure, herein said to be making sternway.

Another distinction relates to the tow sides as references: port (p) to left, starboard (s) to right as viewed from aft of the tow. Thus for headway as defined a ship or shore off to a side of the tow is either to port and to the left or to starboard and to the right. With sternway a ship or shore to the left is off to the tow's starboard or if to the right is then off the tow's port side. Accordingly, a tow making sternway in a channel has its starboard side disposed off midstream and an approaching steamer has its port side off midstream.

Still another distinction relates to hawser towed conveyances where herein: the term vessel includes: dredgers, derricks and the like as more or less sometimes towed and considered construction equipment; barges per se used to transport cargo; and, an LT as disclosed when arranged to effect a tow as distantly connected by one or two hawsers. Herein, distinguishing from said vessels the term LT signifies the integrated tow as disclosed in Reference A whereby the tow may be making headway, then stopped, and caused to make sternway without change in arrangement.

Said vessels when integrated by an 'A' frame, as is the LT, may then be equally maneuverable. Except for the LT, said vessels as conventionally towed depend each time to be stopped or backed with drastic measures as dropping the hawser and bridle as a waterbed drag or to have a tug lashed to the vessel side for its then less effective propulsion means relied on to comfort the vessel.

Channel passages of 100–200 miles length are encountered to contend with tortuous, shallow water and narrows with winds and limited visibility adding perplexities. The S.W. passage linking New Orleans with the "Gulf" and the pass from Skagway to the sea are examples of both a developed area and a remote area.

Channel passages involve unpredictable and strong tidal currents, termed: "head tide" which flows opposite to a tow's directional travel or "fair tide" which flows directionally with said travel (a following current).

Figure 1:
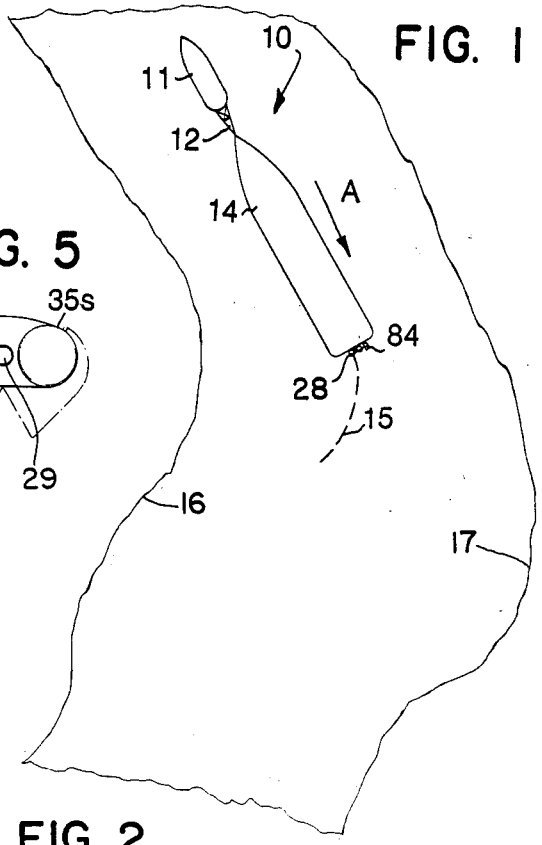
FIG. 1: A plan view diagram of a tow in a channel.

FIG. 1 depicts a said preferred tow 10 comprised of a tug 11 as integrated by 'A' frame 12 to an LT 14. Directional travel of the tow 10 and current in channel 15 for example is represented by the one arrow (A); so by definition the tow is making sternway with a "fair tide". The tow is shown approaching a channel bend as identified to have a "point 16" and a "bend 17". Said "tides" (currents) at bends tend to set a vessel to the "point 16" with "head tides" and to "bend 17" with "fair tides."

Accordingly, this example establishes the tow's port side as being off the near shore having "point 16." Thus, to maintain the near shore proximity, the LT's stern thrustor is orient to starboard for a lateral force to direct the head of the tow (said heading) in opposition to said tendency.

The influence of a "fair tide" on a tow in this sternwise maneuver is ameliorated by the tugs variable pitch (V.P.) propeller as the most aft controlling member (from the tug bulbous bow). With V.P. set for normal headway that propeller then acts as a brake. Conversely, with V.P. set for normal reverse (backing) that propeller sets the tow sternward speed with a moderately influencing "fair tide." The tug bow thrustor serves to establish integrated tow angularity for the tug then to impress a lateral force at the LT bow.

The LT is controlled at both its fore and aft extreme ends to expedite lengthy channel passages. Mooring an LT, as said one situation, depends on a like accommodation as for a channel passage. Thus to dock an LT, the tow approach is slowed, stopped and backed with the tug's controllable pitch propeller (C.P.P.) and bow thrustor serving to laterally dispose the LT bow at will, while the stern thrustor monitors and controls the LT aft end. To be noted Ref. (A) developed a tow's control with a "head tide."

General arrangement

Figure 2:
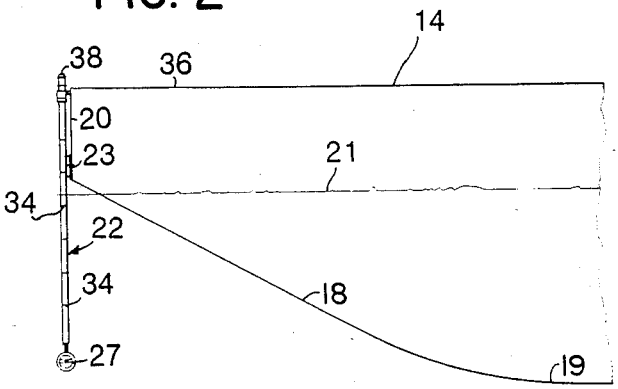
FIG. 2: An elevational starboard side view partially outlining a vessel aft end having a combination buttress/thrustor shown in its erect position.
Figure 4:
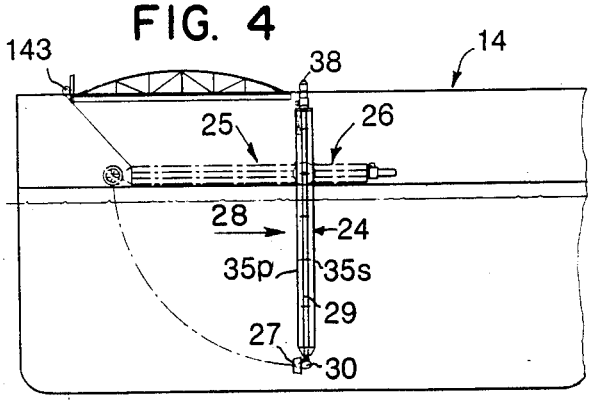
FIG. 4: An aft end view of the vessel showing said erect combination and phantomlike indicating the combination in a stowed position.

As in FIG. 2 the LT 14 aft hull form is comprised of a raked end 18 extending from keel 19 to a vertical transom 20, the latter disposed clearly above design waterline 21. A buttress 22 pivotally mounted 23 to transom 20 is disposed, as in FIG. 4, to a serviceable erect position 24, or alternatively shown phantomlike to a horizontal position 25 as stowed snug to said transom with the LT being towed as at sea.

Aside from having specifically located and sized chocks and bitts, the buttress 22 in combination 26 with a thrustor 27 satisfies Panama Canal code to exempt tow 10 from a "dead tow" classification (nonself-propelled vessel).

Injected now, to be observed most importantly, is the limitation in serviceability of combination 26 for its transient need only when in sheltered waters of coastal inlets. The automatically directionally stable LT at sea has no normal need for said combination except as a redundancy to act as a skeg in the event of an LT rudder failure.

Figure 3:
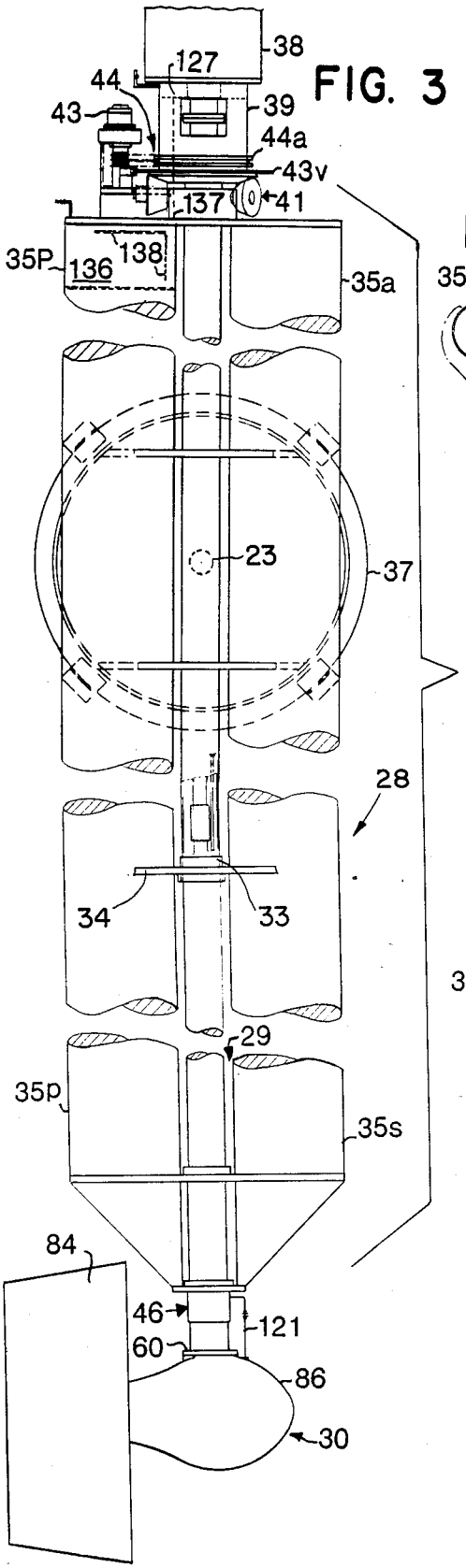
FIGS. 3 (*a, b, c* and *d*): A diagrammatical outline as viewed from aft the vessel of said erect combination, comprising: (3*a*) the upper motor driver column portion (3*b*) the column portion contained pivotal means, (3*c*) the column portion lateral support means, and (3*d*) the lower end column portion with the driven shaft assembly mechanism.
Figure 5:
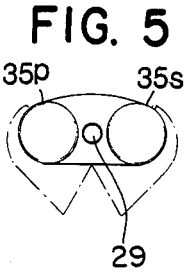
FIG. 5: A plan diagram of the buttress as providing a control bearing means for containment of the thrustor. A means associated with said buttress but not relevant herein is phantomlike shown to represent a guide means for a pusher tug noted herein.

As in FIGS. 3(*a, b, c* and *d*), the serviceable erect thrustor 28 of angular arrangement comprises a vertical motor driver column 29, and an essentially horizontal tear-drop formed housed portion 30 which contains the driven shaft assembled mechanism 31 in support of fixed blade propeller 32. The driver column portion 29 relies for lateral support upon column bearing 33 formed a part of web members 34 which intervally join the buttress two large diameter pipes 35 as spaced apart for a centrally contained said driver column 29.

The erect buttress segment, above pivotal mounting means 23, end extends at least to a level with deck 36 for connection therebetween by a suitable locking engagement means. Said locking engagement establishes an upper end reaction transmitted by said buttress when loaded at its lower end by said thruster or loaded along its lower segment by a pusher tug nosed thereto according to said P.C. code.

The two large diameter buttress pipes 35, as fixed to a peripherally contained disk 37, are disposed to equal sides of the pivotal mounting axis. Thrustor load imposed to control stern waywardness is transmitted by the buttress configuration having a composite sectional modules more than four times each pipes value.

Figures 6B, 6M, 6T:
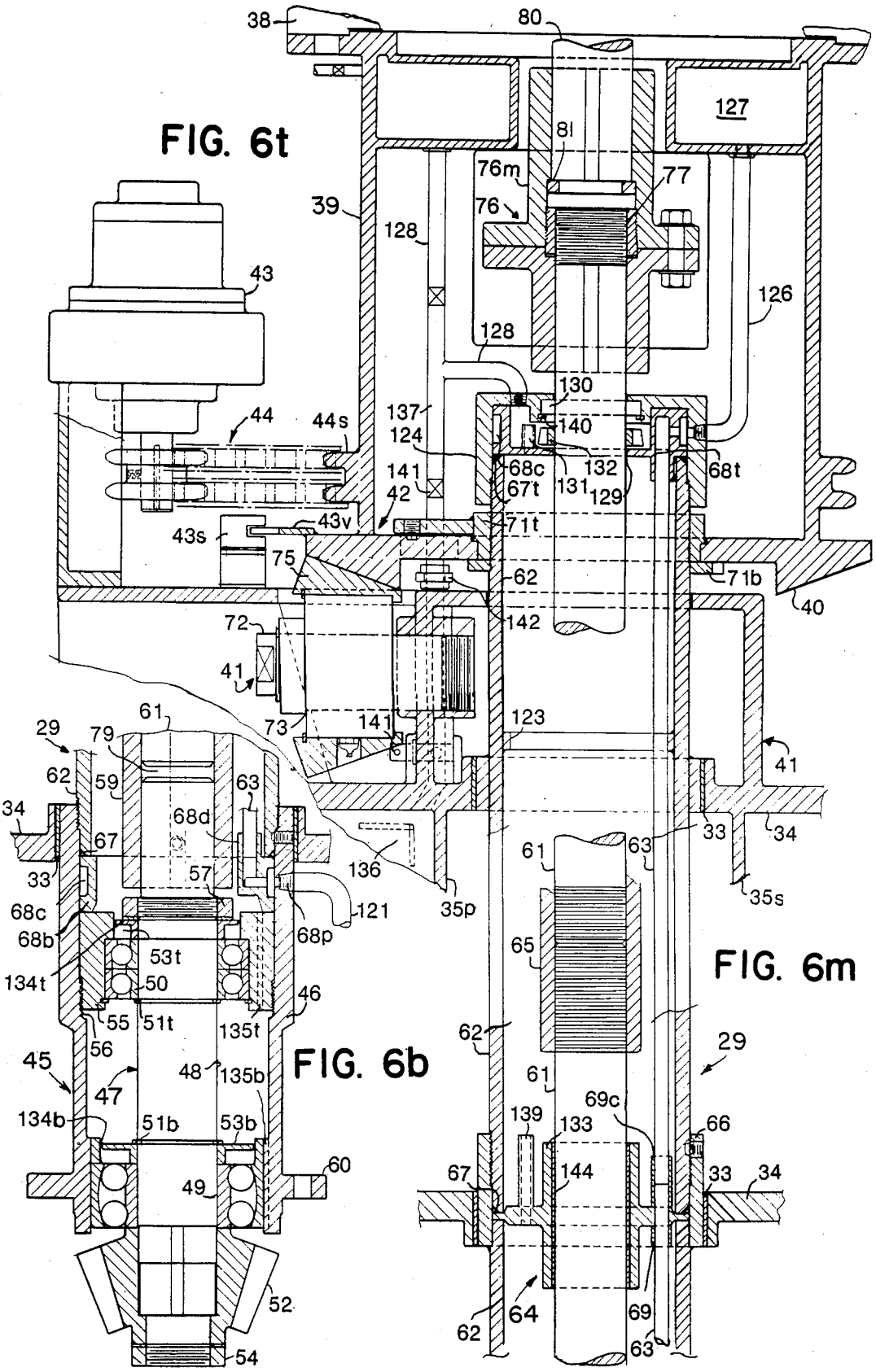
FIG. 6*t:* An elevational upper assembly of the thrustor driver column.
FIG. 6*m:* An elevational interval assembly of the thrustor vertical driver column.
FIG. 6*b:* An elevational lower assembly of the thrustor vertical driver column.

Driver column portion 29 (FIG. 6*t*)

A motor 38, defining the upper end of driver column 29, mounts to weldment 39 which is utilized to provide the bed 40 formed to match fit with a tri-roller assembly 41 defining the upper end of buttress 22. Said match fit of bed 40 and tri-roller assembly 41 in combination provide for a turntable 42, through which dead weight of the entire thrustor is transferred to buttress 22.

A thrustor direction orienting (port or starboard) gear motor 43, as mounted to buttress 22 and linked by a chain means 44 with sprocket 44*s* fixed to weldment 39, serves to turn thrustor unidirectionally through 180° increments. A conventional vane type limit switch 43*s* serves upon being actuated to be effective for a said 180° turn increment.

Said driver column 29 extends beneath the lowest buttress end fitting, a said web 34 with column bearer 33. A driver column lowest appendage 45, with cylindrically formed connector 46, serves in engagement with said column bearing 33 to effect said angular configuration as flanged to housed portion 30 for a propeller clearance beneath the buttress.

FIG. 6*b* details appendage 45 as comprised of cylindrical connector 46 to contain pinion gear shaft assembly 47. Shaft 48 is supported by bottom radial bearing 49 and top thrust/radial bearing 50 as spaced apart by retainer rings 51. Pinion gear 52 butts to the inner ring of bearing 49 which in turn butts to baffle 53*b*. Baffle 53*b* spaces bearing 49 from retainer ring 51*b* when nut 54 with lock washer fixes pinion gear 52 to its shaft. Bearing 49 outer ring is axially free to be positioned as established by the mesh of bevel gears.

An adjusting collar 55, mounted in connector 46 and depending for a fixed axial position therein by threaded engagement therebetween 56, contains outer rings of said bearing 50 between a shoulder and retaining ring. The inner rings of bearing 50 are located by said retaining ring 51*t* and a like baffle 53*t* with lock washer and nut 57.

The required mesh of pinion gear 52 to mating gear 58 is provided by collar 55 vertical adjustment for a said fixed axial position. Shaft 48 extends above connector 46 with key mounted coupling 59.

Prior to disposing the pivotal combination 26 to the stowed position 25, the propeller 32 is oriented to face aft as though a stern propulsion means for the LT. This locates the opposite shorter length of housed portion 30 forward to just clear the transom 20 upon its swing thereto. Said oriented position establishes a port (p) and starboard (s) side to thrustor 27 arrangement and of the two buttress pipes 35.

Driver column three constituents (FIG. 6*m*)

A typical section through the vertical driver column 28 comprise:

(1) A contained shaft 61 to transmit power as key coupled to extended shafts of vertical motor 38 and pinion gear 52.

(2) A heavy walled pipe 62 as the primary structure being tensioned by dead weight of the suspended thrustor 28 and torqued with the need to turn thrustor 27.

(3) A small tubing 63 for upward transfer of lube oil as contained within pipe 62 to the said starboard side of shaft 61.

The three lengthy constituents are a coupled composite of segments with couplings to repeatedly occur in alike dimension vertical spacing from couplings of another constituent. Said spacing accommodates the alignment of segments to be coupled and use of required tools.

Numerically as above (1) Column contained shafting 61 segments are lengthened for each to have two sleeve bearing means 64 to properly support it laterally. The top ends of shafts 61 have its coupling 65 on as the means to fasten tackle for suspending the shaft at assembly.

(2) Said segmented pipe 62 have the upper ends with coupling 66 press fitted and welded on. The lower pipe ends are machined for registry and threaded engagement to the mating finish of said couplings 66. Shaft bearings means 64 fit to said registry and to which segments of pipes 62 butt. The pipe lower end is chamfered to seat an "O" ring seal 67. Couplings 66 are fitted with set screws to lock the threaded pipe connection against antirotation.

(3) Said small tubing 63 segment length approximates that of shafting 61 to extend from bottom cage adaptor 68*b* upward through guide bushing 69 provided by bearing means 64 to a like guide and coupling at is upper end. Repeating segments have a final top end connection to a top cage adapter 68*t* much like but inverted to the one 68*b* below.

Motors are marine type vertical solid shaft, normal thrust, with grease lubricated bearings. Motors operate in a vertical position and store with shafts horizontal. Motor base weldment 39 centers with pipe 62 and turntable arrangement 42. Adjusting ring collars 71 establishes said tension in pipe 62 to effect said transfer weight of thrustor 27 through turntable 42 to buttress 22. Collars 71 are set screw locked to position to integrate pipe 62 to base bed 40.

Stub shafts 72 for the turn table roller bearings 73 are thread adjusting to the buttress appendage 41 so that races 75 may be set radially equal to uniformally share the weight of thrustor 27. Angular contact of races 75 to the turntable bed 40 provide for an automatic centering and a like angular velocity between the revolving race 75 and the rotating bed 40 diametrical increment of contact with race 75 to avoid sliding friction.

Flange coupling 76 through keys to shafts transmits motor torque. Column contained shaft 61 top end as said keyed is also threaded for adjustable engagement by collar nut 77 to establish a required gap 79 of said suspended shaft lower end above pinion gear shaft 48. Nut 77, threaded to motor shaft coupling portion 76*m*, conveys the contained shaft 61 weight to motor shaft 80. Split ring 81 set in a groove formed in motor shaft 80 serves, as shrouded, to be a retainer ring for coupling part 76*m*.

Threads for shafting 61 and pipes 62 are cut R.H. Thus a unirotational driving linkage means 44 between driver column 29 and buttress 22 works to tighten joints as the thrustor is turned port-starboard-port-clockwise as viewed from above combination 26.

Housed Portion 30

Figures 7A, 7B:
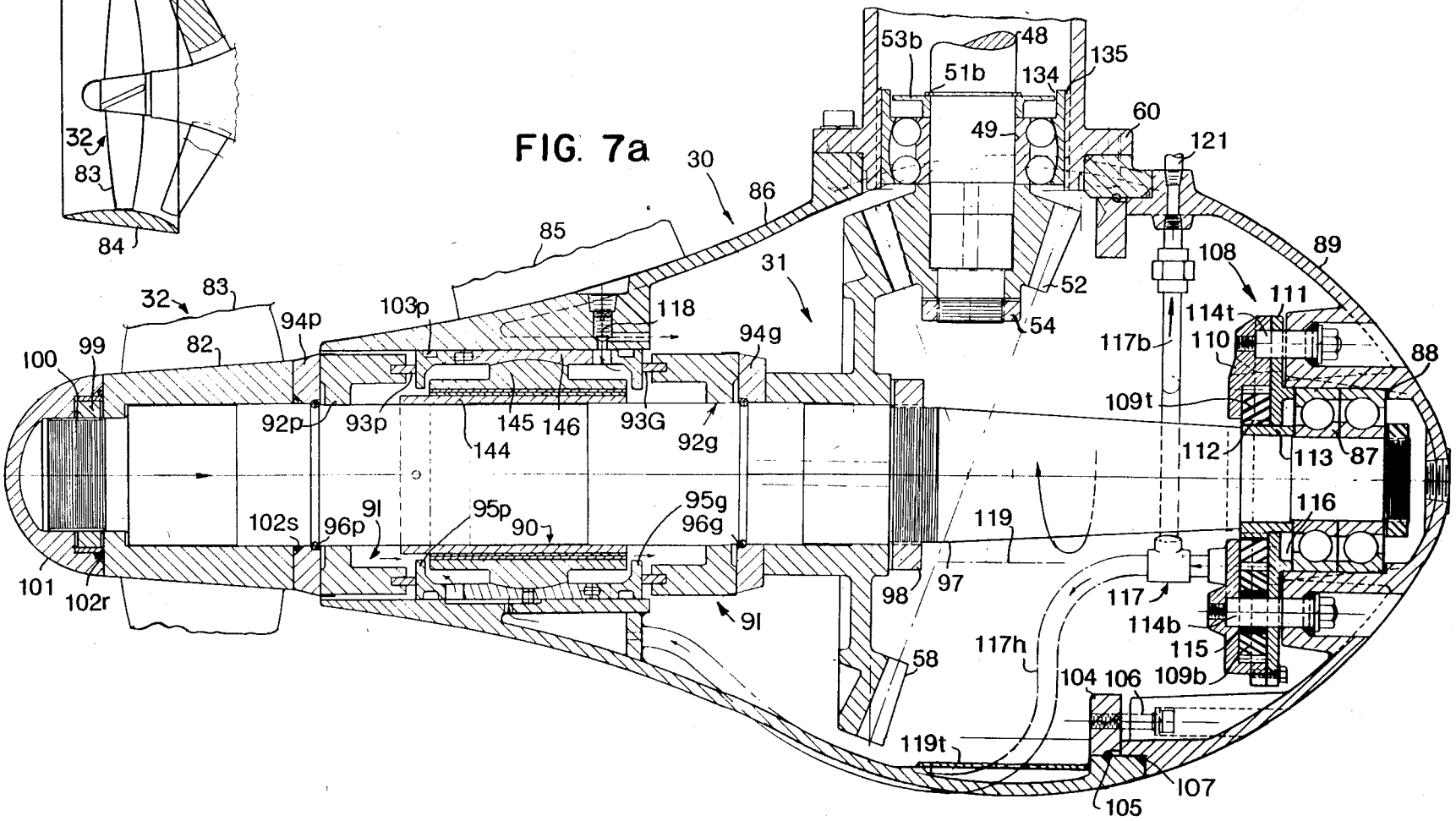
FIG. 7*a:* A partial sectional assembly of the thrustor horizontal housed portion.
FIG. 7*b:* A partial outline of a shrouded propeller as extending from said housed portion.

The sectional assembly FIG. 7*a* of the thrustor gear assembly and propeller shaft mechanism 31 discloses a composite arrangement of parts. Only the hub 82 portion of propeller 32 is shown to understand propeller blades 83 are shrouded by a nozzle 84 as fixed by three vanes 85 to housing 86, FIG. 7*b*.

Propeller thrust developed, as transmitted to housing 86, is shared by the opposing thrust of bevel gear 58 and the thrust capacity of bearing 87. This bearing also provides one end radial support of the propeller shaft 97. Optimal axial position of gear 58 respective pinion gear 52 is established by laminated shims 88 placed between bearing 87 and its shoulder fit to housing cover 89.

The opposite inboard bearing support means 90 of shaft 97 located between the propeller 32 and gear 58 is a self-aligning hardened and ground, low friction, non-gauling (Stellite) combination of parts. (A roller bearing being an alternative to replace the above bearing.) A pair of (John Crane Co., EK) seals 91, as employed contains bearing 90 in an oil circulating system. In arrangement with housing 86 and mechanism 31, seals 91 establish an isolated chamber to be oil flooded under a pressure in excess of external water pressure at the immersed depth of the propeller.

The molded elastomer body 92 with intergral Manetex face inserts 93 are compressed between shaft collars 94 and face plate fixtures 95. The primary seal is at the interface of the rotating said insert 93 and face plate 95. The grip of bodies 92 to its common rotating faying surfaces prevents leakage therethrough. Retainer rings 96 establish the fix of collars 94 to shaft 97 with collar **94*p* adapted for remachining to establish the required compression of seals 91 as determined by a preassembly measurement. Collar 94*g* provides abutment for bevel gear 58 as set by lock washer and nut 98, and collar 94*p* provides abutment for propeller hub 82 as set by lock washer and nut 99. Nut 99 is shrouded by ring 100 and cap 101 thread mounts to shaft 97. An "O" ring 102*s* and "O" ring 102*r* are set as accommodated to preserve remountability of the propeller hub. Face plates 95 are grooved for at least the outboard one 95*p* to contain an "O" ring 103*p* to complate the end seal of said housed portion 30** extended for faired lines to the propeller.

Housing 86, sized to clear preassembled said mechanism 31 with the propeller temporarily replaced by a suitable sleeve, is sealed off by an accommodatingly lengthened end cover 89 to enclose said mechanisms. Shoulder ring 104 set by retaining ring 105 provides an internal flange means for stud bolting 106 the cover and housing together with "O" ring 107 to seal that joint.

An oil circulating gear pump 108 typically comprises a pair of spur gears 109, housing 110, and cover 111. Gear **109*t* centers with and is driven by shaft 97 by typical means of spline/teeth 112 engagement with spacer collar 113 keyed to shaft 97. Stud bolt 114*t* centers from shaft 97 to equal gear centers. Stud bolt 114*b* serves as the center support for spur gear 109*b* which is fitted with bearing 115**.

Stud bolts 114, thread mounted to gear housing 110, serve to center and contain the gear pump assembly 108 as jambed by a collar part 116 of said cover 111 caused to bear against the outer rings of thrust bearing 87 with said stud nuts tightened. Recesses in cover 89 accommodate the nut, washer an "O" ring combination to be served by socket wrenches. With the arrangement to contain gear pump 108 the required axial fix is achieved for the outer rings of thrust bearing 87. To be noted cover stud bolts 106 are similarly arranged for recessed and sealed fasting to preserve a streamline cover contour.

Gear pump 108 is established with its suction to maintain a proper oil level for said thrust bearing 87. Discharge tubing from gear pump 108 is a manifold 117 by suitable fittings to supply lube oil for seals 91 developed isolated chamber and bearings of the driver column 29.

Lube oil circulation

A manifold 117 flexible tubing leg **117*s* for seals 91 connects by said suitable fitting to a heavy wall small opening tube 117*h* which is configured to contoured housing 86. Cast steel housing 86 is molded to provide an accommodating slot for tube 117*h* to be welded thereto for a water tight homogeneous housing. Said accommodation lessens the size of housing 86**.

Oil circulation (indicated by arrows) exit with controlled flow by needle valve 118 to free fall to sump 119 having an oil level established by the suction of said gear pump. Said level suits bearing 87. A trap **119*t* disposed lowermost in said sump accumulate unwanted matter as retained with the swing of combination 26 to a horizontal position for discharge from pipe plugged drain (not shown) then lowermost respective said housing 86**.

The lube oil gear pump manifold leg **117*b* feeding the said small tubing 63 within the driver column 29 is thread connected though housing cover 89 above the propeller shaft axis. This locates the external pipe tubing 121 for a least water disturbing flow to the propeller. Said external tubing is union coupled to connector 46** as subsequently disclosed.

Assembly of the oil circulating said small tubing 63, contained within driver column 29, is disposed to said starboard side of contained shafting 61. Then with combination 26 stowed horizontally 25 and with housed portion 30 inboard of the LT port side, the assembled tubing 63 is disposed beneath shafting 61. A ring 123, fixed midway within each segment of pipe 62, provides a center rest of the horizontally disposed tubing 63 between its guide means 69, FIG. 6*t*.

Cage adaptors 68, as cylindrically contained, serves to establish an annular ring formed chamber **68*c* to receive lube oil introduced to it. A fluid conduit means 68*p* through the side of the member providing said containment serves chamber 68*c*. A vertical coupling means 68*d* formed in fluid communication with said annular chamber 68*c* establishes a connection to secure the top and bottom extremities of tubing 63. This defines said union coupled exterior tubing 121 with connector 46 (as noted subsequently to be disclosed) and occurs below said buttress lowest end web 34 with column bearing 33. Said means 68*p* threads horizontally through connector 46 for said communication to the annular chamber 68*c* of cage adapter 68*b***, FIG. 6*b*.

Cage adapter **68*b*, contained in connector 46, seats to adjusting collar 55 and provides the abuttment for the bottom end of pipe 62 to effect its said "O" ring 67 seal. A cylindrically formed top cap 124 as threaded to pipe 62 contains top cage adapter 68*t* for the top end connector of tubing 63. Adapter 68*t* butts to pipe 62 to repeat the "O" ring 67 seal. Cap 124 is said horizontally fitted for exit oil circulation by a conduit 126 connected to a secondary reservoir 127 formed with weldment 39. An exit conduit 128 with valve from reservoir 127 provides fluid communication through the top of cap 124. Cage adaptor 68***t* accommodates the uncertain orientation of said starboard disposed tubing 63 and cap 124 thread mounted to pipe 62, FIG. 6*t*.

Adapter 68*t* provides a floor 129 with close running fit to shaft 61 to trap an oil supply as contained to lubricate seal 130 secured to cap 124. A standpipe 131 establishes a level of said supply and means to bypass oil in the gravity feed system established from said secondary reservoir 127. A flinger 132 fixed to shaft 61 when rotated assures splash lubrication of seal 130.

Each bearing means 64 similarly traps a supply of oil to a level above the tubing portion 133 of said means 64, as established by a standpipe 64*p* to bypass excess circulated oil. Somewhat, alike, the two bearings 50, 49 mounted in connector 46 have said baffles 53 arranged with said bearing mounting means to provided an oil leakage area 134 which establishes a required flow of oil through said bearings. Vertically drilled holes 135 through said means have upper ends above said baffles to establish an assured said flow and to bypass said excess oil circulated, FIG. 6*b*.

Lube oil volume control

A primary reservoir 136, formed within the upper most end of the buttress port pipe 35*p*, accommodates disposition of lube oil between it and the thrustor as portioned for the thrustor erect or said stowed horizontally. In the horizontal position port pipe 35*p* is disposed above the driver column 29. A union fitting 142 between two valves 141 in flexible conduit 137 when joined connects said reservoirs 136, 127 to transfer excess gallonage than reservoir 136 stores.

An oil level gage 138 for reservoir 136 indicates when the required amount of lube oil has been introduced to the thrustor assembly 27; to be the portion in circulation during its operation. A reserve oil supply remains in the reservoir 136 with the thrustor assembly 27 flooded. A valved vent line serves reservoir 136 and another vents the thrustor assembly at reservoir 127.

Oil drained from said chambers falls to one after the other lower column shaft bearing means 64. Each bearing means 64 traps a supply of oil for drainage through a standpipe 64*p* to the lowest bearing 49 for splash lubricant to bevel pinion gear 52.

Seal 130 fixed by ring 140 in cap 129 maintains the flooded condition with the pivotal combination horizontal. Then in an erect position with the shaft driven said seal 130 is included in the vertical bearing system to be lubricated as noted.

Vent valves are closed prior to the swing of the pivotal combination to its stowed position. Upon the need for the thrustor, the pivotal combination is elevated angularly up past its horizontal position to dispose reservoir 136 lowermost for gravity drain of lube oil thereto. A second oil sight gage indicates a reservoir equal contained volume when said disposed lowermost as to that volume when erect and uppermost. Then one of two valves 141 for said flexible conduit 137 is closed, the said erect position established and the reservoir oil level checked ok.

An excess oil reserve in the reservoir 136 requires more gravity drain as controlled by said one of two valves 141. A deficient oil supply in reservoir 136 requires a motor 38 start up to actuate the oil gear pump 108 to discharge oil with the control of said one valve 141. The motor 38 is shut down said two valves closed and said conduit union 142 disconnected with the oil levels determined correctly adjusted. A disconnected union 142 allows thrustor 27 to be turned.

Adverse affects with air containment occurs only during the short time during a voyage when the thrustor is operating. The thrustor assembly remains flooded when the pivotal combination is erected solely to be a buttress. An option to avoid air containment involves the manifolding of a nitrogen flask and pressure pump to the drive column vent.

Miscellaneous

A ladder fixed to the transom provides access as needed to the stowed pivotal combination 26. A ladder built to the buttress 22 provides the means to inspect and contend with possible entanglements to the erect combination 26.

The simple deck winch means 143 to erect or stow combination 26 indicates ready adaptability to be a performing appendage to the LT or to be disposed out of the way and sheltered from sea effect.

Radial bearing 90 is comprised of sleeve 144, bushing 145 as spherically contained by split shell 146. Shell 146, collars 94 and fixtures 95 in sliding fit to the bore of housing 86 accommodate said preassembled mechanism 31 and free positioning respective said shim 88 requirement.

Roller bearing 73 (purchased) is comprized of double row, self-aligning roller bearings contained in a housing adapted with end seals. Said housing is adapted for grease replenishment. Conical race 75 fitted to said housing as detailed are angularly configured for rolling contact with bed 40.

Vane type limit switch 43*s* augments the starter push button switch for the motor 43 (all purchased conventional items as is chain means 44.) Push on the starter switch causes the thrustor 27 to turn for vane 43*v* (arc form) to enter recess slot of switch 43*s* which then serially maintains the turn of the thrustor for a lapsed 180° turn. A repeated action introduces the second half of vane for a completed 360° said unirotational turn.

Shaft bearing means 64 comprises a tubing 133 welded to a disk which has mounted to it a standpipe 139 and guide means 69. Said means 64 is machine to receive a sleeve type bearing 144 and to provide said coupling 69*c* for the said starboard orientation of tubing 63.

Bearing 50, 87 (purchased) are duplex face to face mounted for angular ball contact between the inner and outer rings with said rings fixed axially. Bearing 49 is a double row self aligning ball bearing with inner ring fixed axially and outer ring in creeping fit with connector 46.

Power needs for thrustor 27 are readily available from the tug 11 integrated to the LT 14 by means of cables depending on disconnect fittings such as purchased from Crouse Hind. Alternatively an auxiliary generator means aboard the LT may be used.

The length of driver column 29 is a composition of said constituent segments as arranged. Thus simple assembly of produced constituent parts not only facilitate the said erection and assembly but also accommodates their use for various sized LTs. Combination 26 may be applied as a portable appendage for said construction considered vessels 13.

Summary of elements comprising combination 26

Tow 10, as arrangeable per Reference A and intended for global range, infers LT 14 satisfies P.C. code of which buttress 22 is a prerequisite for passage through P.C. waters and as outfitted with combination 26 voids any dead tow concept with tow 10. Combination 26 is the arrangement of buttress 22 to contain and support thrustor 27 as a transiently needed erect positioned structure 28 in sheltered waters or stowed snuggly horizontally 25 clearly above water for prolonged tows at sea.

Construction of buttress 22 comprises two large diameter pipes 35 spaced apart by web members 34 intervally located and at ends of said pipes. Pipes 35, as bracketed to peripherally contained disk 37, pivotally mounts 23 to LTs stern transom 20 clearly above water. Column bearing 33 fixed in web 34 provide lateral support of driver column portion 29 of thrustor 27.

Lengthy driver column 29 in erect position 28 extends beneath lowest column bearing 33 as appendage 45 for connection 60 to essentially horizontal housed portion 30 to establish an angularly configured thrustor 27. Motor 38 establishing the top of driver column 29 connects thereto by weldment 39.

Heavy pipe 62 upper threaded end extends through the bed 40 base part of weldment 39 to engage with adjusting nuts 71 for a fix means with said base. Appendage 41, being a tri-roller assembly, establishes the top end of buttress 22. Bed 40 centered and rested on appendage 41 establishes a turntable means 42 to transfer weight of thruster 27 to buttress 22.

Turning gear motor mechanism 43 mounted to buttress 22 connects, by chain means 44 (shown phantom-like) to sprocket **44*s* fixed to weldment 39 to turn thrustor 27 for 180° increments as controlled by a conventional vane type limit switch 43*s***.

The normal orientation of propeller 32, as supported by housed portion 30, is to port or starboard respective sides of the LT. Housing 86 fairing water flow to the propeller and the propeller shrouding nozzle 84 extends more from said connection 60 than does the end of housing cover 89. To effect position 25 said nozzle faces aft whereupon said thrustor is determined to have a port and starboard side as are pipes 35 so delineated.

Three lengthy constituents of driver column 29, being main structural member heavy walled pipe 62, centrally contained shaft 61 and small tubing 63 which is said starboardly disposed to said shaft 61, have each a composite length of segments coupled together. A constituent's segmented means, with its couplings repeatingly equal vertical spacing from a coupling of another constituent, facilitates erection and assembly of said lengthy driver column 29.

Heavy walled pipe 62 segments, halving the length of shafts 61 and as coupled together, accommodate the registry and sealed mounting thereto of a shaft sleeve bearing means 64. Bearing means 64 comprises a disk with central tubing 133 machined for bearing 144 for shaft 61, said disk supporting a bypass standpipe 139 contains a supply of lube oil above the level of tubing 133, and a guide coupling 69 for small tubing 63 as disposed to the starboard side of shaft 61.

In said horizontal position 25 with housed portion 30 disposed towards the LT's port side, said small tubing 63 disposes beneaths shaft 61 when a ring 123 fixed within and midlength of heavy wall pipe 62 segment provides a rest for tubing 63 spanned between its guide coupling 69.

An adjusting collar 55 disposed within cylindrical connector 46 accommodates vertical positioning of pinion shaft means 47 to establish the mesh of pinion gear 52 to bevel gear 58 which is mounted on driven shaft 97. Shaft 48 extends above connector 46 with a coupling 59. Coupling 76 with motor 38 provides the means to transmit power and suspend shaft 61 for its lower end disposed with a gap 79 above and for key coupling to shaft 48.

Housed portion 30 comprises driven shaft 97 as supported by end thrust bearing 87 and radial bearing 90 which is disposed between propeller 32 and bevel gear 58. A pair of sealing means 91, as arranged a part of driven shaft mechanism 31 and shrouded by housing 86, provides an isolated chamber for flood lube oil containment of bearing 90. Said oil containment establishes an internal oil pressure across said seals to exceed the external water pressure at the immersed depth of the propeller.

Bevel gear 58 fixed to shaft 97 depends for its proper mesh with pinion gear 52 upon the shimmed 88 containment of bearing 87 within housing cover 89. Housing cover 89, with recesses to contain "O" ring sealed stud bolts 106, depends on an internal flange means 104 for its "O" ring 107 sealed fastening to housing 86.

A lube oil circulating gear pump 108 of conventional parts and fixed to said cover depends on a spline 112 teeth arrangement with shaft 97 for drive and to allow for the axial shaft displacement consequential with said shimmed accommodation and with said fixed pump contributing to said containment of bearing 87.

Two other said recesses similarly serve stud bolts 114 for said fix of gear pump 108 with stud bolt **114*b* serving as the center for spur gear 109*b* having a bushing 115 and spur gear 109*t* with internal teeth for said spline arrangement 112**.

Lube oil circulation, provided by a manifold 117 of piping from the discharge of pump 108, serves said isolated chamber as controlled by needle valve 118 for said pressure and bearing means 64 of driver column 29. Means provided accommodate said piping 117 disposition so as to not increase the size of housed portion 30.

Lower cylindrical connector 46 and cylindrical top cap 124 thread coupled member for the top of heavy walled pipe 62 contains adaptor 68 as the terminal fittings for tubing constituent 63. Said adapters as contained by cylindrical members provide an annular chamber for a supply of oil in fluid communication with a horizontally threaded fitting through said cylindrical members, and a vertical coupling means for fluid transfer between said chamber and tubing 63. Said chamber **68*c*** accommodates the uncertain orientation of threaded members as engaged.

A secondary reservoir 127 formed in said weldment 39 contains a supply of lube oil circulated, as transmitted thereto by conduit 126 from cap 124 and discharged therefrom by conduit 128 to top cap 124. Adapter **68*t* said contained in top cap 124 forms a trap for a supply of lube oil to be bypassed 131 as drained to each bearing below for final collection in sump 119. Suction of gear pump 108 establish the level of said sump 119 to suit bearing 87**.

A primary reservoir 136 formed in the top end of said port pipe **35*p* connects to said secondary reservoir 127 by a flexible conduit 137 having a union type disconnect fitting 142 disposed between two valves 141. As said stowed with the combination 26 said horizontal 25 then primary reservoir 136 is above secondary reservoir 127 for lube oil to flood voids within thrustor 27. With combination 26** pivotally mounted with housed portion 30 above said horizontal 25 then lube oil partially returns to primary reservoir 136.

Essential details effecting the combination 26 as disclosed in the preferred embodiment are considered pertinent with this summary towards the development of said thrust force.

Figure 8:
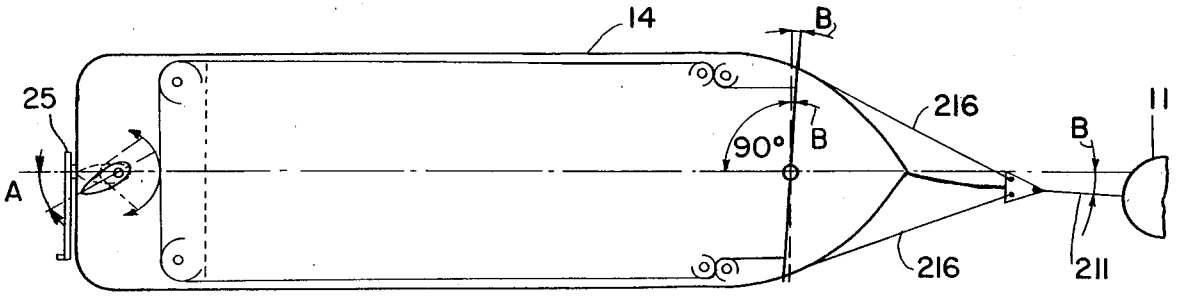
FIG. 8: A partial diagrammatical plan view of the automatically controlled tow at sea arranged with a single towline.

FIG. 8 depicts a tow at sea using a single twoline 211. Towline 211 is fixed to a flounder plate serving as the vertex connection of bridle legs 216*p* and 216*s*. In FIG. A "B" indicates the angle departure of the steering beam to which bridle legs 216*p* and 216*s* are fixed.

Figure 9:
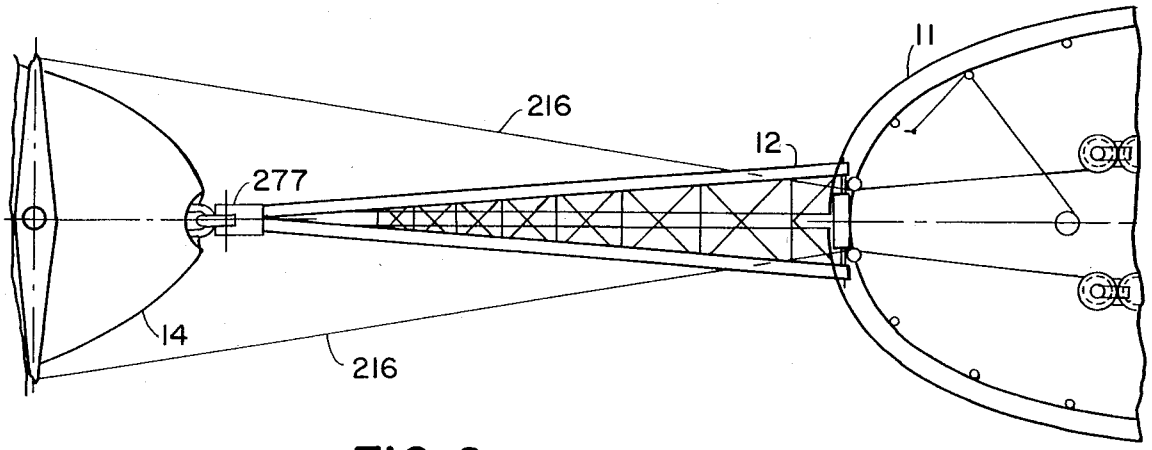
FIG. 9: A partial diagrammatical plan view of the integrated tow in sheltered water as universally coupled together and arranged with dual towlines.

FIG. 9 depicts a tow using an "A" frame 12, clamp means 277, and bridle legs 16*s* and 16*p*.

FIGS. 8 and 9 are incorporated from U.S. Pat. No. 4,275,677 which describes each of these types of towing in more detail.

What is claimed is:

1. For a tow making sternway in sheltered waters as an articulatively integrated tug and LT, comprising an interconnecting horizontally arranged 'A' frame with one end hinged to the tug stern rail, for an alternative inoperative 'A' frame prone position to the tug after deck, and the distal other 'A' frame end universally connected to the prow of the LT, including a vertical operatively positional buttress with pivotal mounting means above water level to the transom of the LT, for an alternative buttress horizontal inoperative position, and an alternative tow arrangement to make headway at sea by a single towline connecting the tug and LT having said 'A' frame and buttress to a horizontal inoperative position, the improvement to control sternway comprising:

(a) a vertically positioned buttress extending between the deck and keel of the LT, having an upper segment above the pivotal mounting and a lower segment below the pivotal mounting, comprising two pipes with bearing centrally contained spacing means fixing pipes together and with the pivotal mounting means;

(b) a thrustor having a column portion comprising three segmentally coupled constituents, of a column driver shaft intermittantly bearing supported, a column oil transfer tube and a pipe column enclosing structure with the column portion further having fluid tight connected thereto at one end a mechanism housed portion comprising a driven propeller shaft with bearing support means, a bearing mounted spiral bevel gear means effecting a right angle transfer of power from the driver shaft to the driven shaft, a lube oil circulating means, a propeller shaft end sealing means with said mechanism accommodating the mounting of the propeller therewith;

(c) the combination of buttress and thrustor centrally contained therewith in vertical operative position, comprising a turntable to support the suspending thrustor dead weight having a turntable roller means fixed to the buttress upper segment and a turntable bed centered above the roller means, and further comprising a weldment having said bed for a base portion thereof and an adjustable connecting means for the column portion suspending therefrom and laterally supported by said bearing contained spacing means;

(d) a motor, fixed atop the weldment, providing drive and dead weight support of the driver shaft, and said weldment providing a contained lube oil upper secondary reservoir;

(e) said lube oil circulating means, serving a controlled oil volume for the vertically operative positioned thrustor, including a pump and manifold connected to said tube with adapters directing fluid flow to flood the upper secondary reservoir, and having controlled gravity oil flow lubricating intermittently positioned driver shaft bearings and having oil bypass means diverting excess lube oil past bearings;

(f) a gear motor means fixed to the buttress above the turntable having power transmitting means with said weldment providing unidirectional selectively intermittent turning of the thrustor in 180° increments for a laterally directed thrustor respective the LT stern and further having selective power control of the column portion uppermost motor turning the propeller for thrusting to said control sternway;

(g) a primary reservoir of lube oil compartmented in said upper segment of one of said two pipes, having the buttress in horizontal inoperable position, providing gravity feed with control means, flooding the entire interior of the said centrally contained thrustor beneath said one pipe; and, (h) a control means, with the combination being erected to vertical operative position, diverting oil circulation from said gravity oil flow to said primary reservoir, removing oil from the flooded thrustor, restoring said controlled oil volume.

2. A tug and LT, as a primary tow extendingly connected together by a single towline, providing automatic tow headway including an LT transom disposed buttress pivotally mounted for a horizontal inoperative above water first position, and as a secondary articulatively integrated tow having dual towline serving the arrangement for sternway with said buttress erected to a vertical operative second position, the improvement comprising:

(a) the buttress having two pipes with spacing means fixing pipes together and to pivotal mounting means, including centrally contained sleeve bearing means providing dead weight first position support means and lateral second position support means and a second position roller bearing dead weight support means;

(b) a combination, having a thrustor centrally contained and supported by the buttress in the second position, selectively providing a lateral force to the LT stern, comprising vertical column and horizontal housed thrustor portions in fluid tight, right-angled arrangement, housing a column portion driver shaft and housed portion driven shaft, a housed spiral bevel gear means effecting said right angled arrangement, and further comprising a motor, with shaft coupling means atop the vertical column portion to drive and supporting the dead weight of the driver shaft and having a propeller, mounted to an outer extending said housed driven shaft, for selective powering by said motor, and including a house contained lube oil system selectively providing circulating lube oil in controlled flow for said second position and a flood oil housed contained thrustor in the first position;

(c) the buttress, in combination with the thrustor, having means to unirotationally turn the supported thrustor through 180° increments to selectively direct said lateral force with selective powering of the propeller; and, (d) the thrustor having coincident position application with the buttress, providing the combination in said second position operatively controlling the LT stern waywardness with the tow making sternway, and the combination in said first position stowed to inoperative flooded condition.

* * * * *